United States Patent [19]

Matsuoka et al.

[11] Patent Number: 4,661,743

[45] Date of Patent: Apr. 28, 1987

[54] FLUORESCENT DISPLAY TUBES AND METHOD OF MANUFACTURING THE SAME

[75] Inventors: Nobuyuki Matsuoka; Yo Takasaki; Sadao Minamitsu; Katsumi Motoyama, all of Kagoshima, Japan

[73] Assignee: Nec Corporation, Tokyo, Japan

[21] Appl. No.: 582,535

[22] Filed: Feb. 22, 1984

[30] Foreign Application Priority Data

Feb. 22, 1983 [JP] Japan ..... 58-24896[U]
Apr. 19, 1983 [JP] Japan ..... 58-58495[U]
Apr. 20, 1983 [JP] Japan ..... 58-58946[U]

[51] Int. Cl.[4] ..... H01J 5/16; H01J 17/10; H01J 61/40; H01K 1/26

[52] U.S. Cl. ..... 313/496; 313/497; 313/513; 313/112

[58] Field of Search ..... 313/496, 497, 513, 517, 313/518, 519, 489, 474, 112, 503, 506

[56] References Cited

U.S. PATENT DOCUMENTS

| | | | |
|---|---|---|---|
| 4,142,126 | 2/1979 | DuBois | 313/497 |
| 4,396,864 | 8/1983 | Suntola et al. | 313/506 |
| 4,455,774 | 6/1984 | Watanabe | 313/496 |
| 4,468,589 | 8/1984 | Hikida et al. | 313/496 |

FOREIGN PATENT DOCUMENTS

| | | | |
|---|---|---|---|
| 0028163 | 2/1983 | Japan | 313/496 |

*Primary Examiner*—Thomas G. Wiseman
*Assistant Examiner*—Elizabeth C. Weimar
*Attorney, Agent, or Firm*—Burns, Doane, Swecker & Mathis

[57] ABSTRACT

In a fluorescent display tube of the back luminescence type, a transparent colored film is formed on a transparent substrate. A mesh shaped anode segments are formed on the transparent colored film, and a fluorescent layer is formed to cover the anode segments.

10 Claims, 5 Drawing Figures

FLUORESCENT DISPLAY TUBES AND METHOD OF MANUFACTURING THE SAME

BACKGROUND OF THE INVENTION

This invention relates to a fluorescent display tube that displays digit, symbols, patterns or the like by the luminescene of a fluorescent material, and a method of manufacturing the display tube.

In one type of the prior art fluorescent display tube, as shown in FIG. 1, an insulating substrate 1 is coated with a black insulating layer 2 which surrounds anode segments 3. A fluorescent material 4 is coated on the anode segments 3. Grid electrodes 5 are disposed at positions above the anode segments with proper spacing therebetween and filaments 6 are disposed at a proper spacing from the grid electrodes. Thereafter a glass cover 7 with its inner surface deposited with a transparent electroconductive film is sealed to the anode substrate to form a sealed vacuum container. However, with such a display tube, since the displayed digit or the like are viewed through the glass cover, the field of view is narrow.

In contrast, another fluorescent display tube, in which an insulating substrate is made transparent, an anode segment group disposed on the insulating substrate is made of a transparent material, a fluorescent material is coated on the anode segment and the fluorescent display is observed through a surface of the anode substrate opposite to the surface on which the anode segment is formed, has a wider field of view than the former display tube. Hereinafter, the latter construction is called a back luminescence type.

FIG. 2 is an enlarged partial sectional view showing a prior art fluorescent display tube of the back luminescence type in which electroconductive material for example, aluminum is applied by sputtering on a transparent insulating substrate 11 and the sputtered film is photoetched to form lead patterns 14 and transparent segment electrodes 32. Then the lead patterns 14 are covered by an insulating layer 12.

A fluorescent material such as ZnO:Zn is coated on the transparent segment electrodes 32 by electrophoresis or printing technique to form a layer of fluorescent material 33. The resulting structure is housed in a container to be evacuated (not shown) together with cathode and grid electrodes to be described below.

Electrons emitted from a filament cathode electrode 16 are accelerated by a grid electrode 15 and impinge upon the fluorescent material 33 to cause it to luminesce. Displayed digits and the like are observed through the transparent segment electrodes 32 and the transparent insulating substrate 11. In recent years, however, a variety of types of displays have been desired to be made and request for multicolor display has become stronger. To meet such requirement, it is necessary to change the composition of the fluorescent material for satisfying the customer's request for color of respective displayed patterns. This requires repeated coating operations of fluorescent materials for different color patterns, thus not only increasing the number of process steps but also decreasing yield of satisfactory products, which increases the cost of manufacturing.

Moreover, as it is necessary to change the composition of the fluorescent material for different colors, the brightness levels differ for respective displayed color patterns, which makes it difficult to observe displayed patterns.

SUMMARY OF THE INVENTION

It is an object of this invention to provide an improved fluorescent display tube of the multicolor back luminescence type that can decrease the manufacturing cost and have high display quality, and a method of manufacturing the display tube.

Another object of this invention is to provide a novel multicolor fluorescent display tube and a method of manufacturing the same in which it is not necessary to change the composition of the fluorescent material for different colors.

According to one aspect of this invention, there is provided a fluorescent display tube wherein displayed digits, letters or the like are observed from the side of a transparent anode substrate opposite to the side on which anode segments are formed, comprising a transparent colored film formed on the inner surface of the anode substrate, the anode segments being made of transparent electroconductive material and formed on the colored film, a layer of fluorescent material covering the anode segments.

According to another aspect of this invention, there is provided a method of manufacturing a fluorescent display tube of the back luminescence type comprising the steps of preparing a transparent insulating substrate, forming a colored glass layer, on one surface of the substrate, forming a metal layer on the colored glass layer and on the one surface of the substrate, etching a portion of the metal layer for forming mesh shaped anode segments and a lead conductor pattern extending therefrom, covering the lead conductor pattern with an electric insulating layer, and coating fluorescent material on the mesh shaped segment electrodes to form a fluorescent layer.

According to a modified method of this invention, an ultraviolet ray setting type resin is printed to form a printed pattern on the side of the substrate opposite to the side on which the mesh shaped anode segments are formed, and the printed pattern is irradiated with ultraviolet rays.

DESCRIPTION OF THE PREFERRED EMBODIMENTS

Figure 1:
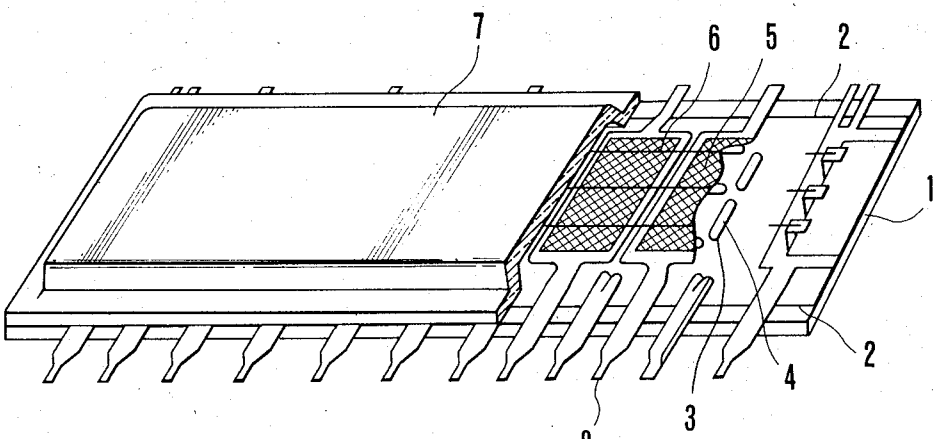
FIG. 1 PRIOR ART
FIG. 1 is a perspective view, partly exploded, showing a prior art fluorescent display tube in which displayed digits, patterns, etc. are viewed from above.
Figure 2:
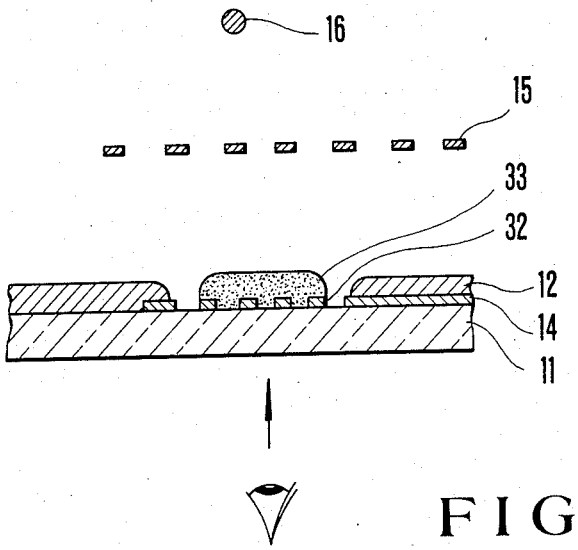
FIG.2 PRIOR ART
FIG. 2 is a partial enlarged sectional view showing a prior art fluorescent display tube of the back luminescence type.
Figure 3:
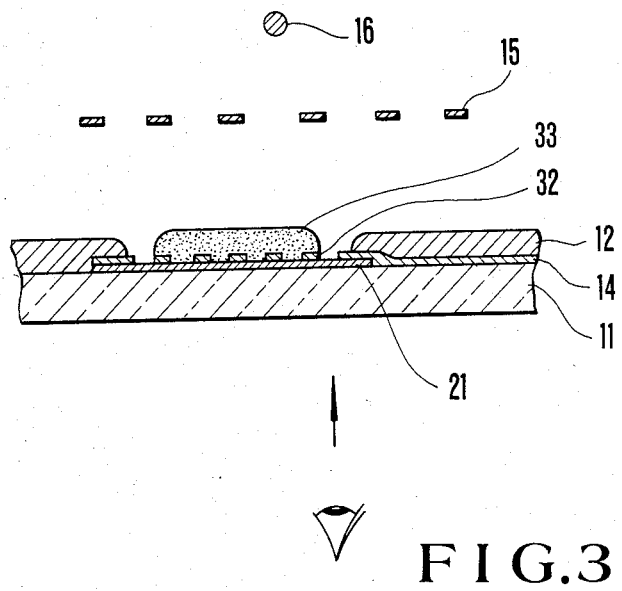
FIGS. 3, 4 and 5 are partial enlarged sectional views showing different embodiments of this invention.

FIG. 3 shows the electrode construction of a multicolor back luminescence type fluorescent display tube according to a first embodiment of this invention. The insulating substrate 11 is made of a transparent glass plate having a thickness of 1.8 mm. A pattern of a colored glass paste prepared by adding a pigment and an organic binder to a low melting point glass powder consisting essentially of lead borosilicate is applied onto the surface of the substrate 11 by screen printing process and then the printed pattern is baked to form a colored film 21 having a thickness of about 10 microns.

Then, aluminum is sputtered onto the colored film 21 to a thickness of 1 to 1.5 microns and the sputtered aluminum film is photoetched to form lead conductor patterns 14 having a conductor width of 50 to 100 microns and mesh shaped anode segments 32 having a conductor width of 20 microns and a mesh pitch of 150 microns. The lead conductor patterns are covered by an insulating layer 12. A fluorescent material, for example, ZnO:Zn, is coated on the top surface and side surfaces of the mesh shaped anode segments by electrophoresis process, thus forming a fluorescent layer 33.

Thereafter, through the same process steps as the prior art method, a fluorescent display tube is manufactured.

In this fluorescent display tube, electrons emitted from the filament cathode electrode 16 are accelerated by the grid electrode 15 to impinge upon the fluorescent layer 33 to cause it to luminesce. Since, according to this invention, only one kind of fluorescent material is provided for one type of products of multicolor fluorescent display tube and luminescence of a desired color is obtained by selecting the kind of colored film 21, accordingly, the kind of pigment, there is no difference in the brightness of the displayed patterns caused by the difference in the composition of the fluorescent material as in the prior art multicolor back luminescence fluorescent type, thereby providing an improved multicolor back luminescence display tube having high brightness and high display quality. Moreover, since in the fluorescent display tube of this invention in which the transparent colored film 21 formed on the inner surface of the anode substrate, the fluorescent layer 33 and the colored film 21 are closely adjacent, the parallax can be greatly decreased as compared to a case wherein the colored film is formed on the outer surface of the anode substrate, thereby ensuring that the field of view can be widened. Moreover, as it is not necessary to change the composition of the fluorescent material for different color, it is possible to decrease the cost of the fluorescent material as well as the cost of manufacturing the display tube to thereby improve productivity.

Figure 4:
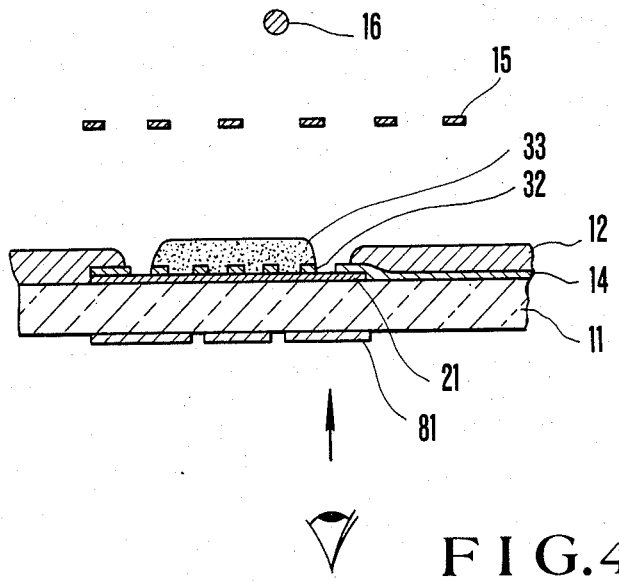

FIG. 4 shows a second embodiment of this invention. Through the same process steps as in the first embodiment shown in FIG. 3, a fluorescent display tube is manufactured. Then on the view side of the display tube, that is, at a position in register with the display pattern on the outer surface of the insulating substrate 11, a pattern having a thickness of about 20 microns is printed by screen printing process by using a ultraviolet ray setting type ink of the epoxy acrylate type, and then the printed pattern is irradiated with ultraviolet rays to form a transparent colored film 81.

In this embodiment, the fluorescent layer 33 is made of ZnO:Zn that emits bluish green color, a transparent red colored film 21 is formed on the inner surface of the transparent substrate 11, and a yellow colored film 81 is pattern printed at positions on the outer surface of the substrate other than those corresponding to digits, letters, etc. When the display tube is operated, the portions corresponding to letters, digits, etc. are displayed in red color owing to the filtering effect of the transparent red colored film 21 formed on the inner surface, whereas the portions other than the letters, digits, etc. are displayed in color tone obtained by synthesizing colors of the colored films on the inner and outer surfaces of the substrate, that is, orange color. Of course, portions being not in register with the colored films 21 and 81 are displayed in bluish green color.

As described above, according to the second embodiment, with only one kind of the fluorescent material, various combinations of different colors and display patterns can be made. Moreover, there is no difference or irregularity of the brightness of the displayed pattern due to the difference in the composition of the fluorescent material as in the prior art multicolor back luminescence fluorescent display tube, thereby providing a high quality multicolor back luminescence fluorescent display tube in which there is no irregularity of the brightness between displayed patterns and having high brightness and highly stable display quality. Further, various kinds of desired chromaticity can readily be obtained by changing the ratio between amounts of the dye and pigment incorporated into the material of the transparent colored films.

Moreover, without changing the composition of the fluorescent material, differently colored patterns can be dislayed by unique combinations of the transparent films on the inner and outer surfaces of the insulating substrate, thus reducing the cost of the fluorescent substance and of the display tube and improving the productivity.

Figure 5:
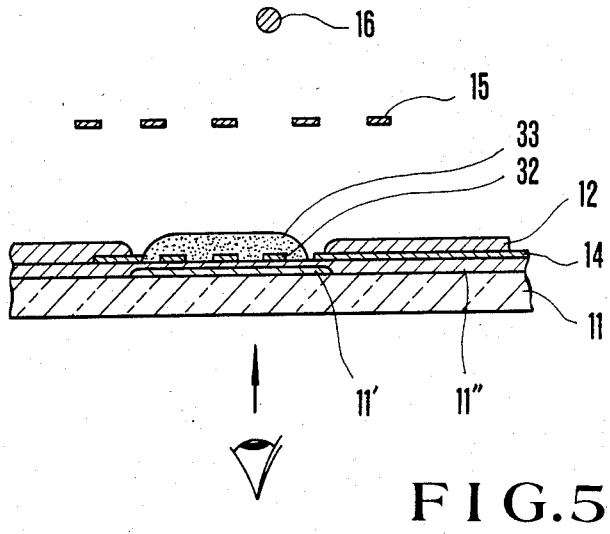

FIG. 5 shows a third embodiment of this invention in which a colored glass paste prepared by incorporating a pigment and an organic binder into a powder of low melting point glass consisting essentially of lead borosilicate is printed by screen printing process on a transparent glass insulating substrate 11 having a thickness of 1.8 mm to form a pattern, and the printed pattern is baked to form a colored film 11' having a thickness of about 10 microns. Thereafter ink consisting essentially of $SiO_2$ colored with brown smoke is printed and then sintered to form a film 11'' having a thickness of about 3 microns.

Then aluminum is sputtered to a thickness of 1 to 1.5 microns and the aluminum film is photoetched to form lead conductor patterns 14 having a conductor width of 50 to 100 microns and mesh shaped anode segments 32 having a conductor width of 20 microns and a mesh pitch of 150 microns. Then the lead conductor patterns 14 are covered with an insulating layer 12. A fluorescent material ZnO:Zn is deposited on the top surface and side surfaces of the mesh shaped anode segments 32 by electrophoresis process to form a fluorescent layer 33.

Thereafter, to complete a fluorescent dislay tube, the same process steps as the prior art method are employed.

In this display tube, too, electrons emitted from the filament cathode electrode 16 are accelerated by the grid electrode 15 to impinge upon the fluorescent layer 33 to cause it to luminesce. Color of emitted light is converted into white when the light transmits through the brown smoke colored $SiO_2$ film 11'' so that a pattern can be displayed in the same color as that of the colored film 11'. Furthermore, when the aluminum film is photoetched to form the anode segments 32, the $SiO_2$ film 11'' acts as a protective film for preventing the colored film 11' from being corroded and faded by an etchant.

As a consequence, the difference in brightness level between the displayed patterns caused by the difference in the composition of the fluorescent material which has been inevitable in the prior art multicolor back luminescence type fluorescent display tube can be prevented, thereby providing a multicolor back luminescence fluorescent display tube of improved quality. Furthermore, according to the fluorescent display tube of this invention in which a transparent colored film is formed on the inner surface of the anode substrate, since the fluorescent material layer and the colored film are disposed closely adjacent, the parallax can be greatly reduced as compared to a case wherein the colored film is formed on the outer surface of the anode substrate, thus greatly widening the field of view.

Moreover, it is not necessary to change the composition of the fluorescent material for different colors, thus decreasing the cost.

It should be understood that the invention is not limited to the specific color tone of the transparent colored film and the shape of the patterns described above, and that the anode segment material or method of manufacturing the same is not limited to those described above.

What is claimed is:

1. A fluorescent display tube comprising:

a transparent anode substrate having an inner surface and an opposing outer surface;

a transparent colored film layer formed on said inner surface;

a plurality of anode segments of a transparent electroconductive material disposed on said transparent colored film layer; and a layer of fluorescent substance covering said anode segments, whereby displayed data indicia are observed from said outer surface of said transparent anode substrate opposite to said inner surface on which said transparent colored film layer is formed.

2. A fluorescent display tube according to claim 1 wherein said transparent colored film comprises a low melting point glass, a pigment and an organic binder.

3. A fluorescent display tube according to claim 1 wherein said transparent colored film comprises a low melting point glass, and a pigment; and a transparent film of $SiO_2$ is formed on the surface of said transparent colored film.

4. A fluorescent display tube according to claim 1 wherein said transparent anode segments comprise mesh shaped segments of an aluminum film, and wherein ZnO:Zn fluorescent material is coated on said anode segments.

5. A fluorescent display tube according to claim 1 further comprising a colored pattern of characters, digits, or symbols formed on said outer surface of said anode substrate.

6. A vacuum fluorescent display tube comprising:

a transparent insulating substrate having an inner surface which faces a filament cathode and an outer surface which forms a display surface of said vacuum fluorescent display tube to be observed;

a transparent colored film layer formed on said inner surface of said insulating substrate;

a plurality of anode segments of a transparent electroconductive material disposed on said colored film layer so as to form mesh shape, said anode segments forming an image to be displayed;

a layer of fluorescent substance covering all portions of said anode segments;

lead conductors which are connected to said anode segments and disposed on said inner surface of said insulating substrate; and insulating layer covering said lead conductors.

7. A vacuum fluorescent display tube according to claim 6 further comprising a colored film, portions of which are printed at separate locations on said outer surface of said transparent insulating substrate remote from those positions corresponding to said image to be displayed.

8. A vacuum fluorescent display tube according to claim 6 wherein said transparent colored film layer comprises a first colored film formed on said inner surface of said transparent insulating substrate and a second colored film overlaying said first colored film entirely.

9. A vacuum fluorescent display tube according to claim 8 wherein said first colored film comprises a colored glass paste prepared by incorporating a pigment and an organic binder into a powder of low melting point glass.

10. A vacuum fluorescent display tube according to claim 8 wherein said second colored film is made of $SiO_2$.

* * * * *